US005713715A

United States Patent [19]

Joubert

[11] Patent Number: 5,713,715

[45] Date of Patent: Feb. 3, 1998

[54] MEASURING FLASK

[75] Inventor: Robert Montaque Joubert, Potchefstroom, South Africa

[73] Assignee: Rotaque (Proprietary) Limited, South Africa

[21] Appl. No.: 516,308

[22] Filed: Aug. 17, 1995

[30] Foreign Application Priority Data

Aug. 26, 1994 [ZA] South Africa ..... 94-6521

[51] Int. Cl.[6] ..... B66B 17/08

[52] U.S. Cl. ..... 414/613; 414/609; 414/657

[58] Field of Search ..... 414/403, 609, 414/610, 612, 613, 615, 616, 657, 658; 222/181.3, 508; 105/308.2, 310

[56] References Cited

U.S. PATENT DOCUMENTS

| | | | |
|---|---|---|---|
| 1,272,515 | 7/1918 | Peck | 105/308.2 X |
| 1,365,979 | 1/1921 | Gardner | 414/657 |
| 1,716,289 | 6/1929 | Allen et al. | 414/613 |
| 2,737,308 | 3/1956 | McMullen | 414/615 |
| 3,612,364 | 10/1971 | Coucher | 414/609 X |
| 4,142,751 | 3/1979 | Varda . | |
| 4,262,603 | 4/1981 | Morse . | |
| 4,423,831 | 1/1984 | Sipley | 222/181.3 |
| 4,564,330 | 1/1986 | McKechnie et al. | 414/609 X |
| 5,122,028 | 6/1992 | Joubert . | |

FOREIGN PATENT DOCUMENTS

| | | | |
|---|---|---|---|
| 0565627 | 3/1958 | Belgium | 414/657 |
| 0586224 | 4/1925 | France | 414/613 |
| 0224238 | 7/1918 | Germany | 222/508 |
| 1056055 | 4/1959 | Germany | 414/657 |
| 1195675 | 6/1965 | Germany | 414/658 |
| 815497 | 8/1982 | South Africa . | |
| 815498 | 8/1982 | South Africa . | |
| 815499 | 8/1982 | South Africa . | |
| 815500 | 8/1982 | South Africa . | |
| 815574 | 8/1982 | South Africa . | |
| 868850 | 7/1987 | South Africa . | |
| 882679 | 11/1988 | South Africa . | |
| 0917266 | 1/1963 | United Kingdom . | |
| 2104495 | 3/1983 | United Kingdom . | |
| 2128173 | 4/1984 | United Kingdom . | |
| 2163135 | 2/1986 | United Kingdom . | |

*Primary Examiner*—James W. Keenan
*Attorney, Agent, or Firm*—Rudnick & Wolfe

[57] ABSTRACT

A measuring flask 10 is described for use in a mine shaft assembly. The measuring flask 10 includes a body 12, a discharge opening 25, a door 24, and a pressurised fluid actuated door locking mechanism 40. The body 12 defines a storage chamber having a sloping bottom 22 and the discharge opening 25 is defined in the body 12 adjacent to the sloping bottom 22. The door 24 is displaceable between a closed position in which it closes the discharge opening 25 and an open position in which is permits material to be discharged from the measuring flask 10 through the opening 25. The door locking mechanism 40 is operable to lock the door 24 releasably in its closed position. Instead or in addition to the door locking mechanism 40, the measuring flask 10 has a resilient door retaining arrangement 50 configured to retain the door 24 releasably in its closed position.

8 Claims, 2 Drawing Sheets

MEASURING FLASK

THIS INVENTION relates to a measuring flask. It also relates to a mine shaft assembly.

SUMMARY OF INVENTION

According to one aspect of the invention, there is provided a measuring flask for use in a mine shaft assembly, the measuring flask including

- a body defining a storage chamber and having a sloping bottom;
- a discharge opening defined in the body adjacent to the sloping bottom;
- a door mounted on the body and displaceable between a closed position in which it closes the discharge opening and an open position in which it permits material to be discharged from the measuring flask through the opening; and
- a pressurised fluid actuated door locking mechanism operable to lock the door releasably in its closed position.

According to another aspect of the invention, there is provided a measuring flask for use in a mine shaft assembly, the measuring flask including

- a body defining a storage chamber and having a sloping bottom;
- a discharge opening defined in the body adjacent to the sloping bottom;
- a door mounted on the body and displaceable between a closed position in which it closes the discharge opening and an open position in which it permits material to be discharged from the measuring flask through the opening; and
- a resilient door retaining arrangement configured to retain the door releasably in its closed position.

The resilient door retaining arrangement may include a spring element mounted on the body and configured to engage the door when in its closed position in order to retain the door releasably in its closed position.

The spring element and door may be configured such that, when in its closed position, the door is supported by the spring element so as at least partially to absorb shock applied to the door by material being fed in use into the measuring flask. Accordingly, shock transmitted to the door operating mechanism and the pressurised fluid actuated door locking mechanism is reduced thereby reducing wear thereon.

The measuring flask may include a pressurised fluid actuated door locking mechanism operable to lock the door releasably in its closed position. This arrangement serves to retain the door in its closed position and thereby prevent inadvertent discharge of material from the flask even in the event of pressure being lost at the ram.

The measuring flask may include pivotal mounting means whereby the door is pivotally mounted on the body for pivotal displacement between its open and closed positions. The measuring flask may include a door operating mechanism for displacing the door between its open and closed positions. Preferably, a door operating mechanism is provided at each side of the flask.

The door operating mechanism may include a linkage mechanism and at least one pressurised fluid operated ram, e.g. a pneumatic ram. The ram may be connected to the door by the linkage mechanism.

The linkage mechanism may include a pivot arm pivotally connected to the body of the flask and configured to be pivoted about a pivot axis by the ram, and a linkage arm linking the pivot arm and the door. Typically, the linkage arm is configured to translate pivotal displacement of the pivot arm into pivotal displacement of the door thereby to permit selective displacement of the door between its open and closed positions upon actuation of the ram. The linkage arms may be directly or indirectly connected to the door.

The door operating mechanism may be configured such that, in displacing the door between its open and closed positions, the linkage arm at least partially crosses over said pivot axis so that the operating mechanism functions as an overcentre locking mechanism to lock the door releasably in its closed position even in the event of pressure being lost at the ram.

The pressurised fluid actuated door locking mechanism may include a latch arrangement. Typically, the latch arrangement includes a pin displaceable by means of a pressurised fluid actuated, e.g. pneumatic, piston and cylinder arrangement between a locking position in which it, when the door is in its closed position, engages a complementary locking formation on the door to retain the door in its closed position, and a released position in which it permits displacement of the door between its open and closed positions. Preferably, a latch arrangement is provided at each side of the body.

The rams and the piston and cylinder arrangements may be configured such that in use, with the door in its closed position, the piston and cylinder arrangement is activated first so as to remove the pin from engagement with the complementary locking formation on the door and the ram is then activated to open the door. In order to close and lock the door in position the reverse procedure is followed with the ram being activated first in order to close the door and the piston and cylinder arrangement being activated once the door is closed to position the pin in engagement with the complementary locking formation.

According to yet another aspect of the invention, there is provided a mine shaft assembly which includes

- a measuring flask as hereinbefore described;
- a feeder chute for directing material downwardly into the measuring flask; and
- a skip in a mine shaft into which skip material discharged through the discharge opening of the measuring flask is fed in use.

The mine shaft assembly may include a feeder trolley having a chute surface for guiding material discharged from the discharge opening into the skip.

The invention will now be described, by way of example, with reference to the accompanying diagrammatic drawings.

DESCRIPTION OF THE PREFERRED EMBODIMENT

Figure 1:
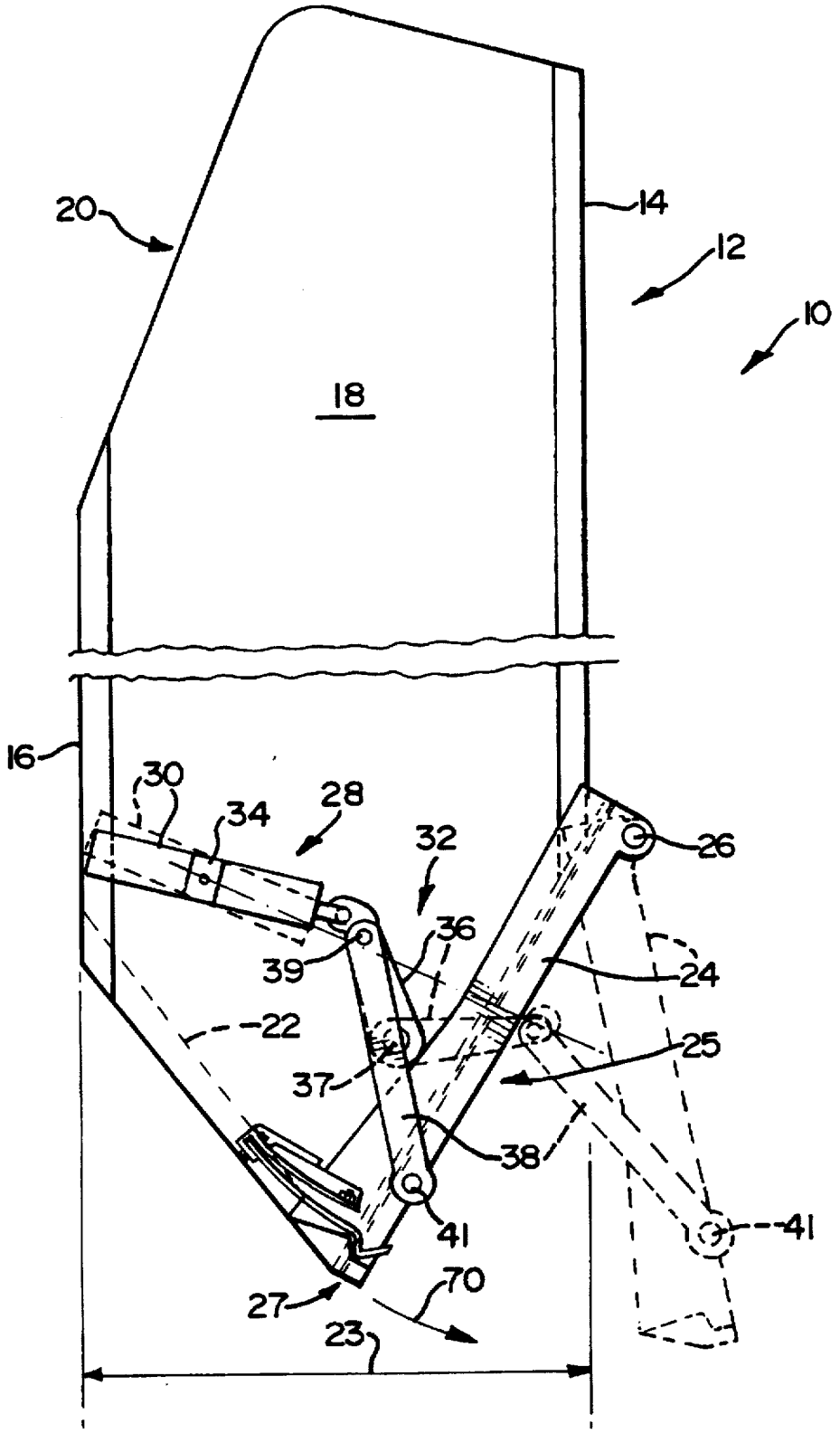
FIG. 1 shows a side view of a measuring flask in accordance with the invention.

In the drawings, reference numeral 10 refers generally to a measuring flask in accordance with the invention. The measuring flask 10 has a body 12 including parallel front and rear walls 14, 16 respectively, and parallel side walls 18 (only one of which is shown in the drawings). The body 12 is of substantially rectangular cross-section in plan view and is reinforced in any suitable manner.

A feeder opening 20 is provided at an upper part of the body 12 for receiving material from a feeder chute (not shown).

A bottom of the body 12 is partly closed by a sloping bottom 22 which is inclined downwardly towards a mine shaft (not shown) adjacent to which the measuring flask 10 is positioned. The bottom 22 extends over more than half of a width 23 of the bottom of the body 12.

A discharge opening 25 is defined between a lower region 27 of the sloping bottom 22 and the walls 14 and 18 of the body 12. The discharge opening 25 is normally closed (as shown in FIG. 1) by a door 24 pivotally mounted on the body 12 of the measuring flask 10 by pivots 26. The measuring flask 10 includes a door operating mechanism, generally indicated by reference numeral 28 (see FIG. 1), for displacing the door 24 between its closed position (shown in solid lines in FIG. 1) and its open position (shown in phantom in FIG. 1). The door operating mechanism 28 includes a pair of pneumatic rams 30 (one of which is shown in the drawings) mounted on opposite side walls 18 of the body 12. Each of the rams 30 is connected to the door 24 by means of a linkage mechanism 32.

Each ram 30 is connected to a side wall 18 by means of a pivot mount 34. Each linkage mechanism 32 includes a pivot arm 36 pivotally connected at pivot 37 to its associated side wall 18 of the body 12 for pivotal displacement relative thereto. The linkage mechanism 32 further includes a linkage arm 38 which is pivotally connected to the pivot arm 36 at pivot 39 and to the door 24 at pivot 41. Thus, actuation of the rams 30 causes pivoting of the pivot arms 36 about pivot 37, causing movement of the linkage arms 38 and hence causing pivotal displacement of the door 24 about pivot 26 thereby opening or closing the door 24. As the door operating mechanism 28 displaces the door 24 from its closed position towards its open position the linkage arm 38 crosses the pivot axis of the pivot 37 about which the pivot arm 36 pivots so that, in the closed position of the door 24, the linkage mechanism 32 is in an overcentre locking position. This serves to lock the door 24 releasably in its closed position and retain it in its closed position even if pressure should be lost at the rams 30 thereby reducing the risk that material would be discharged inadvertently from the measuring flask 10.

Figure 3:
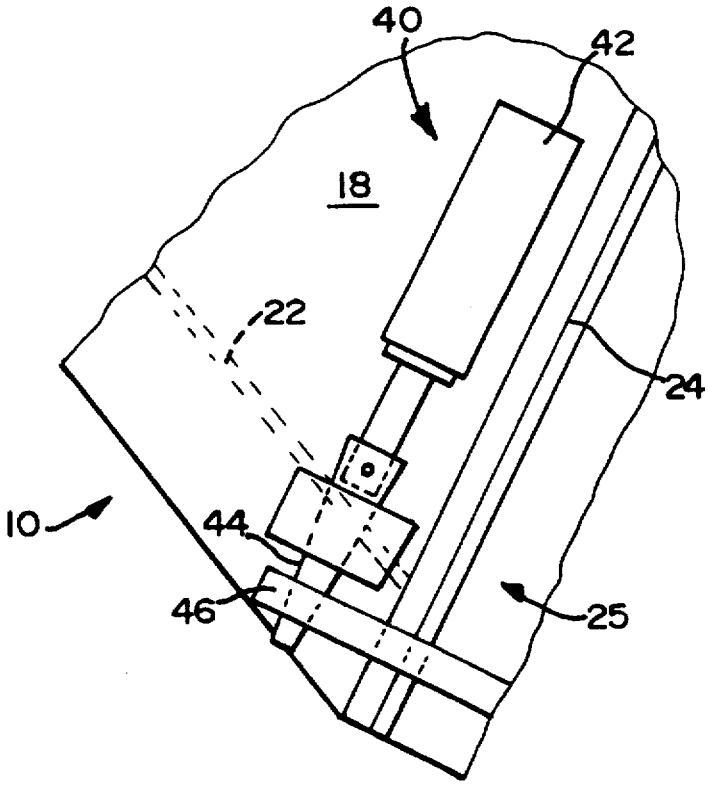
FIG. 3 shows a side view of part of the measuring flask on an enlarged scale illustrating a pressurised fluid actuated door locking mechanism of the measuring flask.

The measuring flask 10 further includes a pressurised fluid actuated door locking mechanism, generally indicated by reference numeral 40 (see FIG. 3). The door locking mechanism 40 includes it pair of pneumatic piston and cylinder arrangements 42 one of which is mounted on each of the side walls 18 adjacent the discharge opening 25. A locking pin 44 is connected to each piston of the piston and cylinder arrangement 42. A pair of complementary locking formations in the form of loops 46 is connected to the door 24 such that in the closed position of the door 24 the loops 46 are in register with the locking pins 44. The locking pins 44 are displaceable by the piston and cylinder arrangements 42 between a locking position, in which they extend into the loops 46 thereby to lock the door 24 in its closed position (as shown in FIG. 3), and a retracted or a released position (not shown) in which they are clear of the loops 46 to permit opening of the door 24.

Figure 2:
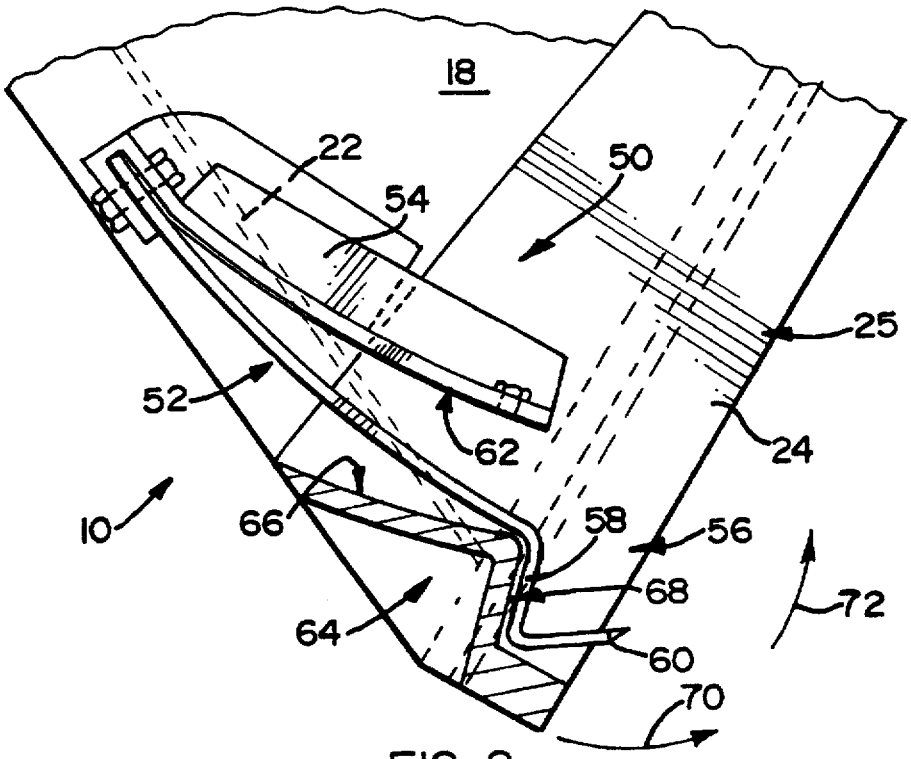
FIG. 2 shows a side view of a resilient door retaining arrangement of the measuring flask of FIG. 1 on an enlarged scale.

In addition, the measuring flask 10 includes a resilient door retaining arrangement, generally indicated by reference numeral 50 (see FIG. 2) configured to retain the door 24 releasably in its closed position as described in more detail herebelow. The resilient door retaining arrangement 50 includes a pair of spring elements 52 one of which is connected to each side wall 18 by means of a mounting bracket 54. The spring element 52 protrudes from a holding formation in the mounting bracket 54 and is gently curved for a portion of its length with a generally L-shaped retaining formation 56 being provided at its free end. The retaining formation 56 includes a downwardly depending portion 58 which is attached to the curved portion of the spring element 52 and an upwardly extending portion 60 which protrudes upwardly from an end of the downwardly depending portion 58. The mounting bracket 54 defines a curved support surface 62 configured to avoid excessive deflection of the spring element 52 as described in more detail herebelow.

A complementary spring engaging member 64 is provided on each side of the door 24. Each spring engaging member 64 defines a gently sloping lead surface 66 and a steeply sloping retaining surface 68.

In use, when the door 24 is in its closed position and the locking pins 44 are in engagement with the loops 46, in order to open the door 24 the piston and cylinder arrangements 42 are actuated so as to retract the locking pins 44 so that they are clear of the loops 46. The rams 30 are then actuated in the manner described above so as to urge the door 24 in the direction of arrow 70 (see FIG. 2), i.e. towards its open position. Initially displacement of the door 24 is resisted by the door retaining arrangement 50, however, the complementary inclination of the downwardly depending portion 58 of the retaining formation 56 and the retaining surface 68 of the spring engaging member 64 serves to urge the spring element 51 upwardly in the direction of arrow 72 until it clears the spring engaging member 64 permitting displacement of the door 24 towards its open position.

In order to close the door 24 the rams 30 are actuated so as to displace the door 24 towards its closed position, i.e. in a direction opposite to the direction of arrow 70. When the lead surface 66 of the spring engaging member 64 makes contact with the upwardly extending portion 60 of the retaining formation 56, the spring element 52 is once again displaced upwardly in the direction of arrow 72. Upward displacement of the spring element 52 continues until the retaining formation 56 clears the lead surface 66 and is in register with the retaining surface 68 thereby permitting the spring element 52 to return to its rest position in which the downwardly depending portion 58 of the retaining formation 56 abuts the retaining surface 68 of the spring engaging member 64.

Once the door 24 is in its closed position, the piston and cylinder arrangements 42 are actuated so as to displace the locking pins 44 into engagement with the loops 46.

By correctly sizing the rams 30 and the piston and cylinder arrangements 42 the correct sequence of operations can be obtained automatically even when air is supplied from a common source.

The measuring flask 10 is used in a conventional fashion in which it forms part of a mine shaft assembly which includes a skip (not shown) mounted in a mine shaft to move upwardly and downwardly. Typically, material which is to be transported by the skip is fed into the measuring flask 10 through the feeder opening 20 (see FIG. 1).

Once sufficient material is in the flask 10 and the skip is in the desired position, i.e. with its upper end adjacent the discharge opening 25 in the body 12 of the measuring flask 10, the door 24 is opened in the manner described above and material flows through the discharge opening 25 into the skip. If desired a feeder chute (not shown) may be provided intermediate the discharge opening 25 of the measuring flask 10 and the skip. Once the material has been discharged from the measuring flask 10 into the skip the door 24 is closed in order that the measuring flask 10 can be re-filled and the skip is displaced to a desired location.

The provision of the resilient door retaining arrangement 50 serves not only to retain the door 24 in its closed position but also to absorb shock transmitted to the door 24 as a result of the introduction of material into the measuring flask 10. This results in a reduction in the shock loads applied to the door operating mechanism 28 leading to a reduction in wear and an increase in operating life. In addition, the provision of the overcentre linkage mechanism 32 and the door locking mechanism 40 serves to lock the door 24 positively in its closed position thereby ensuring that the door 24 cannot open inadvertently even in the event of loss of pressure at the rams 30.

What I claims is:

1. A measuring flask for use in a mine shaft assembly, the measuring flask including a body defining a storage chamber and having a sloping bottom;

a discharge opening defined in the body adjacent to the sloping bottom;

a door mounted on the body and displaceable between a closed position in which it closes the discharge opening and an open position in which it permits material to be discharged from the measuring flask through the opening; and a resilient door retaining arrangement which includes at least one elongate spring element connected at its one end to the body, the free end of the spring element being in the form of a retaining formation, and a complementary retaining formation mounted on the door with which the retaining formation of the spring element engages releasably as the door is displaced from its open position towards its closed position to retain the door releasably in its closed position.

2. A measuring flask as claimed in claim 1, in which the spring element and door are configured such that when in its closed position the door is supported by the spring element so as at least partially to absorb shock applied to the door by material being fed in use into the measuring flask.

3. A measuring flask as claimed in claim 1, which includes a pressurised fluid actuated door locking mechanism operable to lock the door releasably in its closed position.

4. A measuring flask as claimed in claim 3, which includes pivotal mounting means whereby the door is pivotally mounted on the body for pivotal displacement between its open and closed positions, and a door operating mechanism for displacing the door between its open and closed positions.

5. A measuring flask as claimed in claim 4, in which the door operating mechanism includes a linkage mechanism and at least one pressurised fluid operated ram, the ram being connected to the door by the linkage mechanism.

6. A measuring flask as claimed in claim 5, in which the linkage mechanism includes a pivot arm pivotally connected to the body of the flask and configured to be pivoted about a pivot axis by the ram, and a linkage arm linking the pivot arm and the door, the linkage arm being configured to translate pivotal displacement of the pivot arm into pivotal displacement of the door thereby to permit selective displacement of the door between its open and closed positions upon actuation of the ram.

7. A measuring flask as claimed in claim 6, in which the door operating mechanism is configured such that in displacing the door between its open and closed positions the linkage arm at least partially crosses over said pivot axis so that the operating mechanism functions as an overcentre locking mechanism to lock the door releasably in its closed position.

8. A measuring flask as claimed in claim 3, in which the pressurised fluid actuated door locking mechanism includes a latch arrangement including a pin displaceable by means of a pressurised fluid actuated piston and cylinder arrangement between a locking position in which it, when the door is in its closed position, engages a complementary locking formation on the door to retain the door in its closed position, and a released position in which it permits displacement of the door between its open and closed positions.

* * * * *